United States Patent [19]

Kaufman

[11] 3,940,898

[45] Mar. 2, 1976

[54] DOUBLE-PANE WINDOW CONTAINING DRY ATMOSPHERE AND METHOD FOR PRODUCING SAME

[75] Inventor: Albert N. Kaufman, Indianapolis, Ind.

[73] Assignee: K.T. Corporation, Shelleyville, Ind.

[22] Filed: Aug. 20, 1973

[21] Appl. No.: 390,113

[52] U.S. Cl. ..... 52/400; 52/616; 428/34

[51] Int. Cl.[2] ..... E06B 3/64; E06B 3/24

[58] Field of Search ..... 52/173, 172, 304, 398, 52/616, 399, 400; 156/104, 107, 109; 161/45; 428/34

[56] References Cited

UNITED STATES PATENTS

| | | | |
|---|---|---|---|
| 2,612,154 | 9/1952 | Mills | 52/616 X |
| 2,756,467 | 7/1956 | Etling | 52/304 X |
| 2,896,272 | 7/1959 | Latenser | 52/2 |
| 3,212,179 | 10/1965 | Koblensky | 52/403 X |
| 3,305,123 | 2/1967 | Nordby | 161/45 X |
| 3,425,176 | 2/1969 | Cairns | 52/616 X |
| 3,438,166 | 4/1969 | Bakke | 52/398 |
| 3,442,059 | 5/1969 | Kessler | 52/399 |
| 3,608,265 | 9/1971 | Meunier | 52/616 |

FOREIGN PATENTS OR APPLICATIONS

| | | | |
|---|---|---|---|
| 692,563 | 8/1964 | Canada | 52/399 |

*Primary Examiner*—Alfred C. Perham
*Attorney, Agent, or Firm*—Woodard, Weikart, Emhardt & Naughton

[57] ABSTRACT

A double-pane window containing a dry atmosphere is produced by placing two panes of transparent material in a spaced-apart relationship; a sealing means is placed about the periphery of the adjacent faces of the panes of transparent material to enclose a sealed area which is then evacuated and filled with a dry gas. The window is then mounted in a suitable frame to maintain the panes of transparent material in a suitable spaced apart relationship.

8 Claims, 5 Drawing Figures

DOUBLE-PANE WINDOW CONTAINING DRY ATMOSPHERE AND METHOD FOR PRODUCING SAME

BACKGROUND OF THE INVENTION

1. Field of the Invention

This invention is in the field of double paned windows.

2. Description of the Prior Art

In the prior art, especially in the field of mobile home windows, double pane windows have been provided which contain a normal air atmosphere. The moisture between the panes of these windows is capable of freezing and condensing, thereby obstructing vision through the window. Obviously such frost or condensation is inaccessible for removal in order to provide clear vision through the window.

There is a need for an effective yet inexpensive method for producing double paned windows having an enclosed atmosphere incapable of obstructing vision over a desired temperature range.

SUMMARY OF THE INVENTION

In a typical embodiment of the invention, a sealing material is applied along the periphery of a first side of a first pane of transparent material, a plurality of spacers are inserted into the sealing material, a first side of a second pane of transparent material is placed adjacent to the first side of the first pane, the periphery of the first side of the second pane being in continuous contact with the sealing material, the panes are forced toward one another until the panes and the sealing material enclose a sealed area, the spacers maintain the panes in a spaced apart relationship, a portion of the air in the sealed area between the panes is replaced with dry gas, and holding means are provided for maintaining the panes in a spaced apart relationship. A double pane window having a dry atmosphere is thereby provided.

It is an object of the present invention to provide an efficient yet inexpensive method for producing a double pane window having a dry atmosphere.

It is a further object of the present invention to provide a double pane window having a dry gas atmosphere.

Further objects and advantages of the present invention shall become apparent in the following figures and detailed description.

DESCRIPTION OF THE PREFERRED EMBODIMENT

Figure 1:
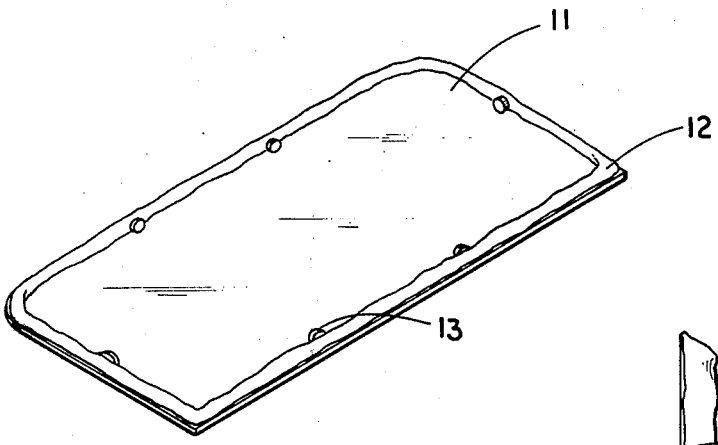
FIG. 1 shows a pane of transparent material with sealing material and spacers.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device and method, and such further applications of the principles of the invention as illustrated therein being contemplated as would normally occur to one skilled in the art to which the invention relates.

Figure 2:
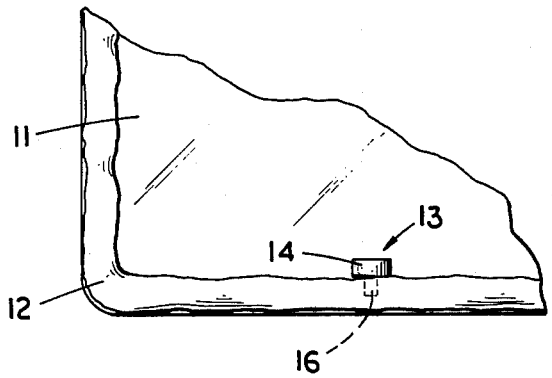
FIG. 2 is an enlarged view of a portion of FIG. 1.

Referring in particular to FIG. 1, there is shown a pane of transparent material 11, which is preferably tempered glass but might also be annealed glass. A continuous mound of sealing material 12 is placed about the periphery of one surface of transparent pane 11. The sealing material preferably is Buterate from Protective Treatment, Inc., of Dayton, Ohio. Plastic spacers such as 13 are placed into the sealing material at intervals about the periphery of pane 11. Spacers 13 include a portion 16 which is inserted into the sealing material (FIG. 2), and a head portion 14 generally circular in shape and having a diameter determinitive of the spacing of the double paned window to be constructed. The continuous mound of sealing material is originally applied to pane 11 in a height or thickness greater than the diameter of head portion 14 of spacers 13.

A second pane of transparent material 17, also preferably tempered glass, is aligned with pane 11 and forced into sealing engagement with sealing material 12. Panes 11 and 17 are forced together until they are maintained in a spaced apart relationship by spacers 13. Since the mound of sealing material 12 was thicker than the diameter of head portion 14 of spacers 13, the sealing material 12 is continuously engaged by the outer edge of the facing surfaces of panes 11 and 17, thereby enclosing a sealed area.

Figure 3:
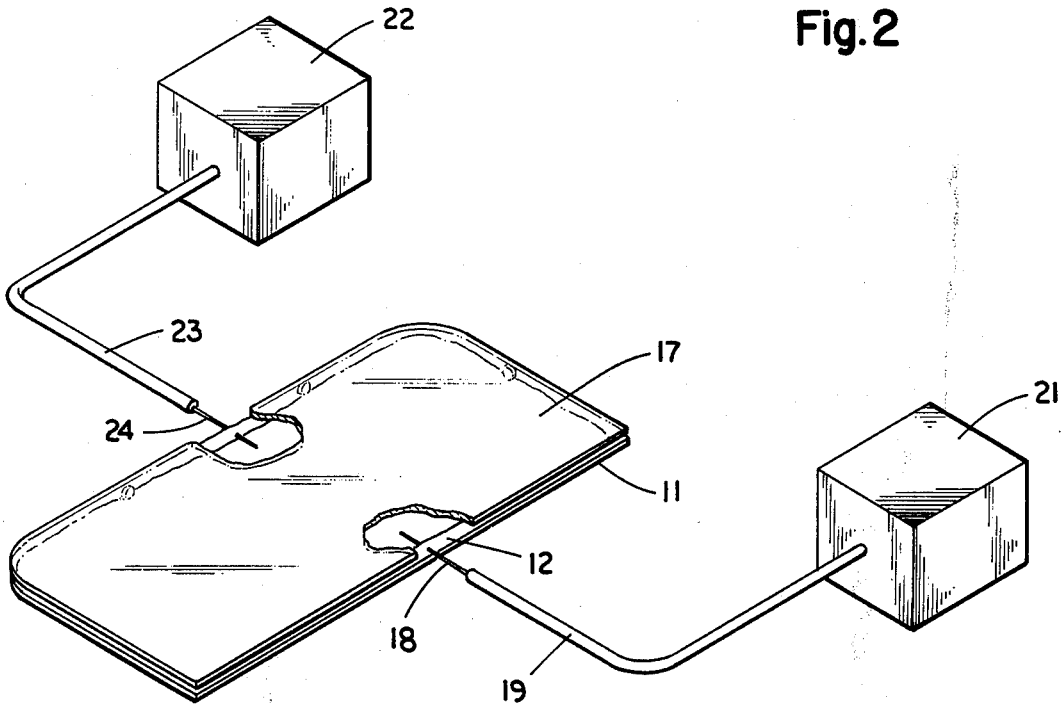
FIG. 3 shows a second pane of transparent material positioned atop the first with portions removed.

In FIG. 3 panes 11 and 17 are illustrated forming the above described enclosed area. However, two portions of upper pane 17 have been shown cut-away in order to more clearly illustrate the procedure for providing a dry atmosphere to the area enclosed between the panes. In accordance with the present invention, there are no portions actually removed from pane 17.

After panes 11 and 17 have been placed in sealing engagement, hypodermic needle 18 is inserted through sealing material 12 and into the enclosed area between panes 11 and 17. Pump 21 evacuates the air from the enclosed area between the panes through hypodermic needle 18 and tube 19 until the panes deform at their centers. Then a dry gas, preferably dry nitrogen, from source 22 is provided through tube 23 and hypodermic needle 24, which is also inserted through the sealing material 12, into the enclosed area between the panes. Needle 18 and needle 24 are disposed on opposite sides of the panes 17 and 11. A second evacuation of the enclosed area by pump 21 and a resupply of dry nitrogen from source 22 is preferred in order to obtain a satisfactory concentration of dry nitrogen gas within the enclosed area between panes 11 and 17. After the enclosed area between panes 11 and 17 has been converted to a dry atmosphere, hypodermic needles 18 and 24 are removed from sealing material 12, which heals itself and closes the holes made by needles 18 and 24. A frame is now provided about the periphery of panes 11 and 17 to form a completed double pane window having a dry atmosphere.

Figure 4:
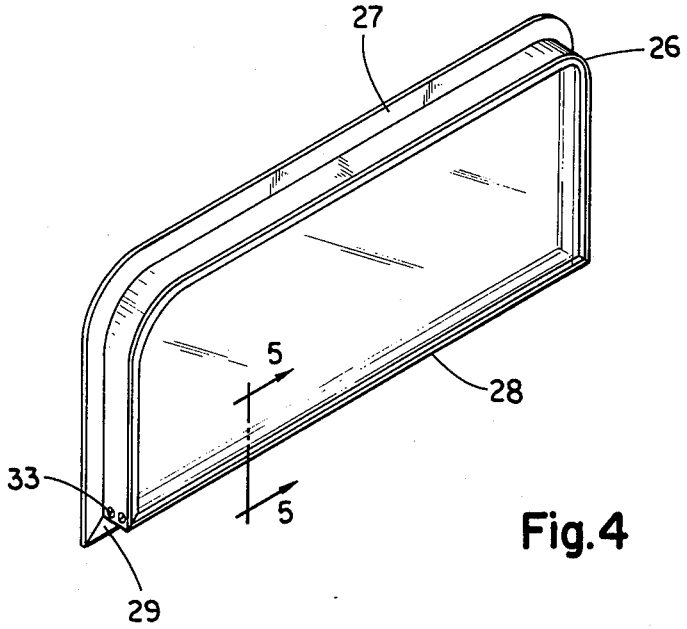
FIG. 4 shows a final window assembly according to one embodiment of the present invention.
Figure 5:
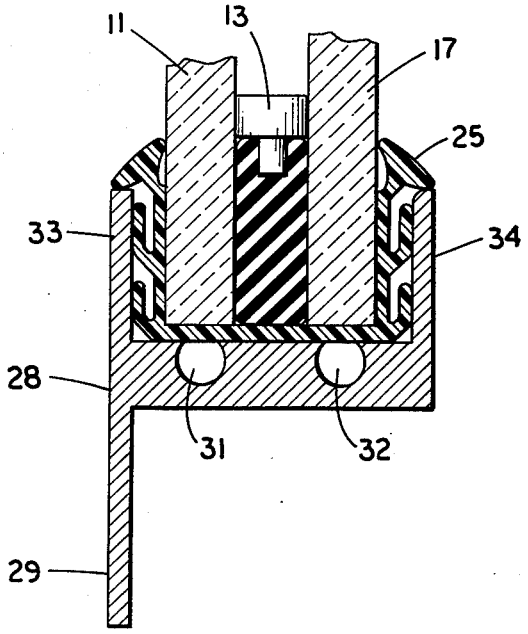
FIG. 5 shows a cross section of part of the window of FIG. 4.

After removal of the hypodermic needles 18 and 24 a vinyl beading 25 is continuously disposed about the edges of panes 11 and 17 (FIG. 5). A two piece frame is then forced over the vinyl beading and the pieces rigidly fastened together. As shown in FIG. 4, a U-shaped framing member, generally indicated as 26, encloses three of the four edges of panes 11 and 17. A second framing member 28 encloses the fourth edge of panes 11 and 17. Channels 31 and 32 extend the length of framing member 28, and holes are provided through the end portions of framing member 26 to coincide with channels 31 and 32 when the frame members are assembled. Self tapping screws such as 33 are provided to rigidly fasten framing members 26 and 28 at their two contact points. Flanges 27 and 29 are provided on framing members 26 and 28 respectively to facilitate the placement of the finished double pane window in a casing such as in a house or mobile home.

FIG. 5 shows a cross sectional view of the double pane window of FIG. 4 along framing member 28. The upper portions 33 and 34 of framing member 28 hold the vinyl beading 25 in sealing engagement against panes 11 and 17. Framing member 26 holds vinyl beading 25 in sealing engagement with panes 11 and 17 in the same manner as framing member 28.

Sealing material 12, while preferably Buterate, may be any flexible adhesive material which is capable of reforming to close the hole from which a hypodermic needle is removed.

It can be seen that the present invention has provided an efficient and inexpensive method for producing a double pane window enclosing a dry atmosphere.

It can also be seen that the present invention has provided an efficient and inexpensive double pane window enclosing a dry atmosphere.

While there have been described above the principles of this invention in connection with specific apparatus, it is to be clearly understood that this description is made only by way of example and not as a limitation to the scope of the invention.

What is claimed is:

1. A double-pane window having a dry atmosphere comprising:

a first pane of transparent material;

a second pane of transparent material essentially parallel with the first pane;

a strip of flexible adhesive material disposed along the periphery of the adjacent sides of the panes of transparent material in sealing engagement with the panes enclosing a sealed area between the panes;

a dry gas within the sealed area between the panes;

a plurality of rigid spacers each having a stem portion inserted in the flexible adhesive material and having a head portion larger than the stem portion, which head portion is in contact with both panes of transparent material and maintains the panes of transparent material in spaced apart relationship; and framing means along the edges and the periphery of the outer sides of the panes of transparent material for holding the panes stationary relative to one another and in contact with the flexible adhesive material.

2. The window of claim 1 in which each spacer has a cylindrical head portion, the diameter of which determines the spacing between the panes of transparent material.

3. The window of claim 1 in which the framing means includes flexible beading and a rigid frame maintaining the beading in sealing engagement with the panes of transparent material.

4. The window of claim 3 in which the flexible beading has a first wall disposed around the edges of the panes of transparent material, a second wall, attached at an end to a first end of the first wall, disposed about the periphery of the outer side of the first pane of transparent material, and a third wall, attached at an end to the second end of the first wall, disposed about the periphery of the outer side of the second pane, the second and third walls each including a first and second flange extending outwardly from the wall and a sealing ledge pivoted on the free end of the wall.

5. The window of claim 4 in which the frame has a first wall positioned over the first wall of the beading, a second wall engaging the flanges of the second wall of the beading and contacting one end of the sealing ledge at the end of the second wall and maintaining the opposite end of the sealing ledge engagement with the first pane of transparent material, and a third wall in sealing engagement with the flanges of the third wall of the sealing bead and bearing against the end of the sealing ledge on the end of the third wall of the sealing bead maintaining the opposite end of the sealing ledge in engagement with the second pane of transparent material.

6. The window of claim 5 in which the first wall of the frame includes a flanged extension essentially parallel to and away from the panes of transparent material.

7. The window of claim 6 in which the dry gas is dry nitrogen gas.

8. The window of claim 7 in which each spacer has a cylindrical head portion, the diameter of which determines the spacing between the panes of transparent material.

* * * * *